US006256806B1

(12) United States Patent
DiTommaso

(10) Patent No.: US 6,256,806 B1
(45) Date of Patent: Jul. 10, 2001

(54) COLLAPSIBLE TRANSFER BENCH

(76) Inventor: Antonio DiTommaso, 866 Main St East, Hamilton, ON (CA), L8M 1L9

( * ) Notice: Subject to any disclaimer, the term of this patent is extended or adjusted under 35 U.S.C. 154(b) by 0 days.

(21) Appl. No.: 09/417,835

(22) Filed: Oct. 14, 1999

(30) Foreign Application Priority Data

Oct. 27, 1998 (CA) ..... 2250548

(51) Int. Cl.[7] ..... A47K 3/12
(52) U.S. Cl. ..... 4/560.1; 4/578.1
(58) Field of Search ..... 4/560.1, 578.1, 4/579

(56) References Cited

U.S. PATENT DOCUMENTS

| | | | |
|---|---|---|---|
| D. 328,490 | 8/1992 | Crawford | D23/304 |
| D. 395,852 | 7/1998 | Ditommaso | D12/128 |
| 4,168,549 | 9/1979 | Davies | 4/578.1 |
| 4,253,203 | 3/1981 | Thomas | 4/559 |
| 4,391,006 | 7/1983 | Smith | 4/559 |
| 4,941,218 | 7/1990 | McCartney | 4/579 |
| 5,373,591 | 12/1994 | Myers | 4/560.1 |

*Primary Examiner*—Robert M. Fetsuga

(57) ABSTRACT

A collapsible transfer bench includes a frame moveable between an extended position and a collapsed position, said frame including at least one channel; and a seat adapted to receive and support a person, said seat cooperatively and moveably engaging said channel such that in said extended position said seat moves longitudinally along said channel and in said collapsed position said frame is portable enough for one person to transport said frame from one location to the other. Furthermore said seat being moveable between an extended position and a collapsed position, such that in said collapsed position said frame together with said seat is portable enough to be transportable by one person from one location to another.

14 Claims, 8 Drawing Sheets

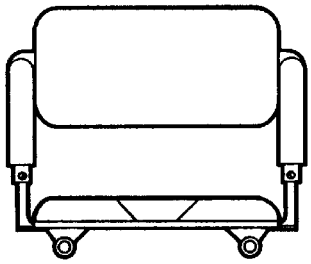
Figure 7
Figure 8
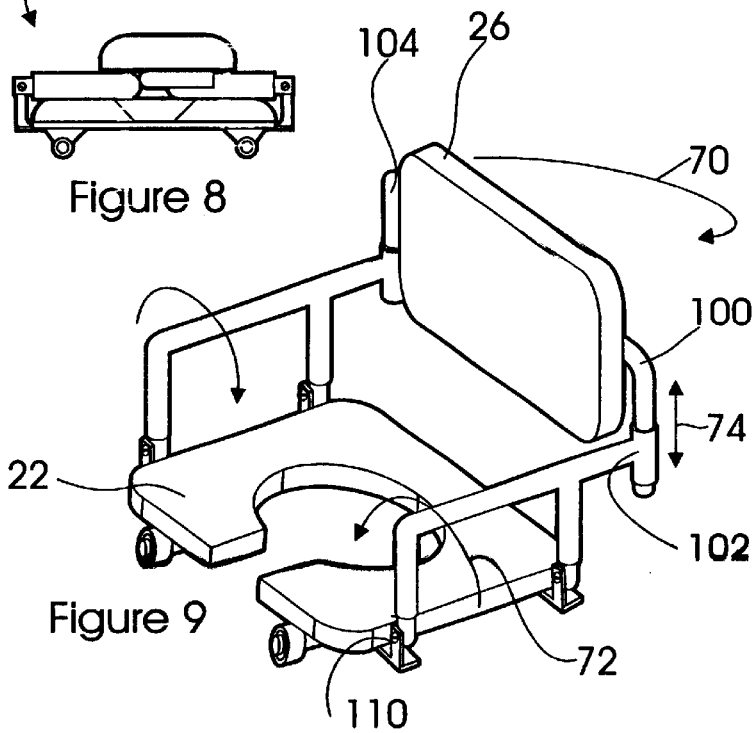
Figure 9
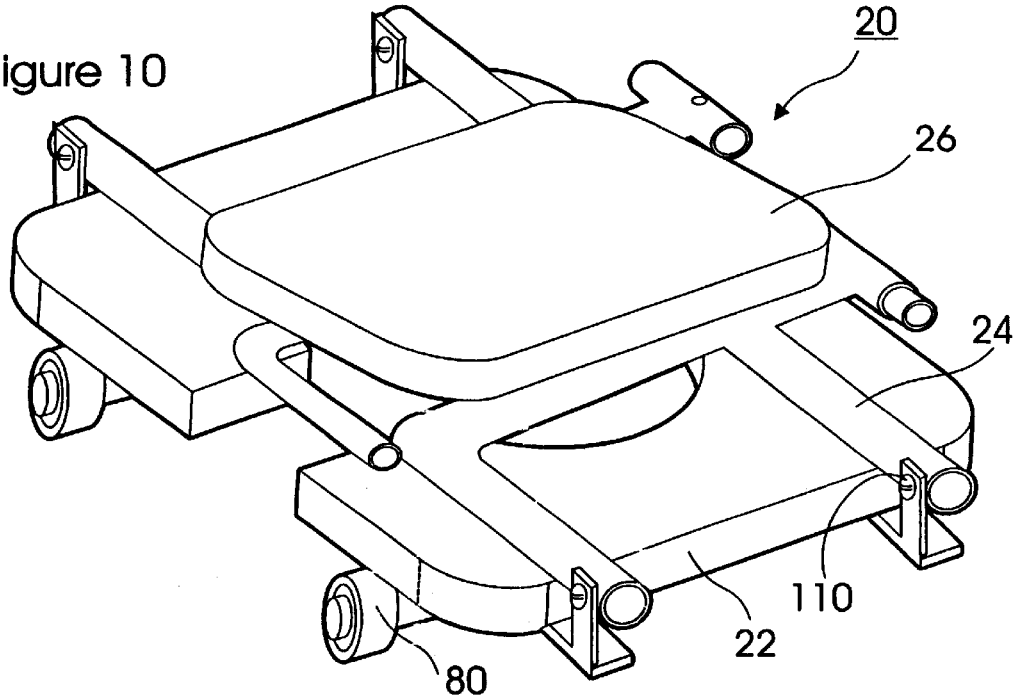
Figure 10

Figure 13
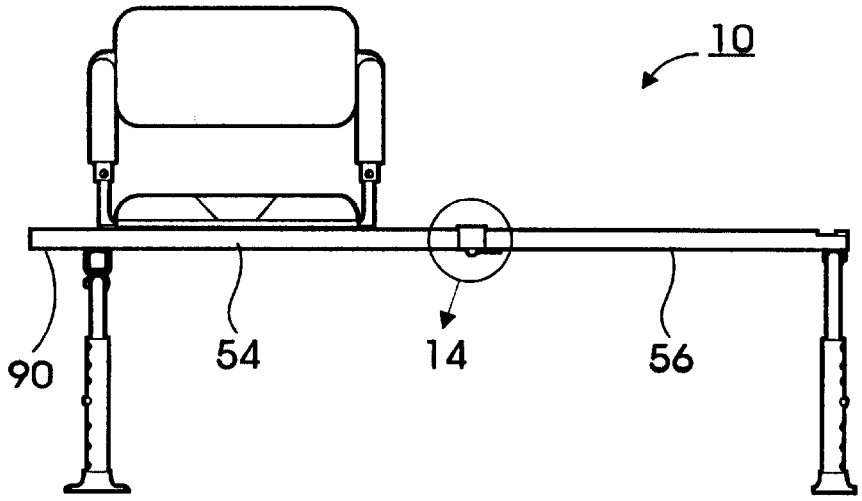
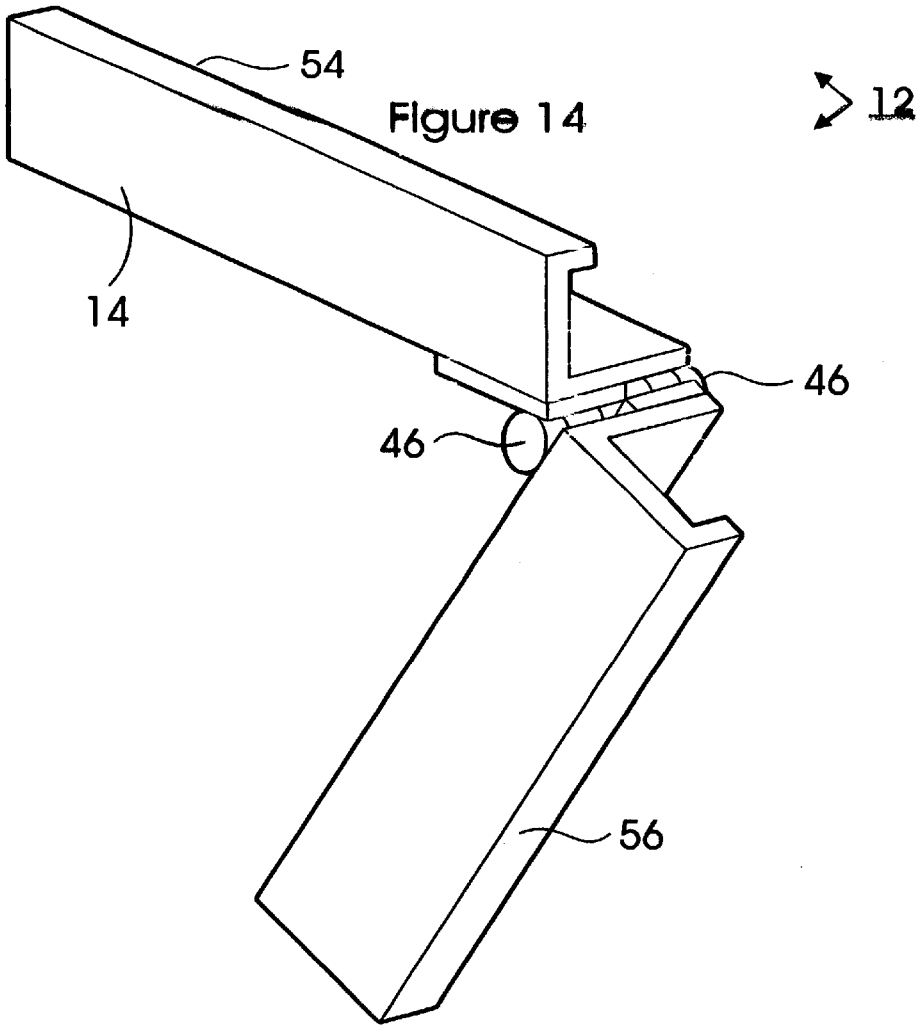
Figure 14

COLLAPSIBLE TRANSFER BENCH

FIELD OF THE INVENTION

This invention relates in general to transfer benches and more particularly to a collapsible, portable, transfer bench.

BACKGROUND OF THE INVENTION on ambulatory persons which include paraplegics face numerous problems in carrying out activities of daily living such as dressing, toiletry, showering, getting into and out of vehicles, buildings and bathing. One of the major problems is merely gaining entry into a conventional bathroom and/or car because of the narrow door ways. Once inside, gaining access to a conventional toilets, bathtubs and/or seats within cars may be very difficult.

Non ambulatory persons often must be lifted from a wheelchair to a bed where they can be most easily undressed and lifted by an attendant and placed into the wheel chair and transported to the bathroom. The non ambulatory person is then lifted from the wheel chair and often carried through the narrow door way and then placed onto a Comdt seat for toiletry or onto a chair which has been placed in the bathtub or shower stall for a bath or shower.

The repeated lifting of the non ambulatory persons causes a lot of physical strain on the attendant and increases the possibility of back strain as well as the danger of accidents such as lifting and falling.

In addition, a non ambulatory person must often be lifted from the wheel chair and into the car through the narrow passageway of the door of the car and once again requires great lifting effort from the attendant and the need for additional persons to attend on the non ambulatory person.

There are several patents which disclose various chair and track arrangements which facilitate the use of bathroom facilities. For example, Thomas, U.S. Pat. Nos. 4,253,203 and 4,359,791 disclose a collapsible bench. Bailey, U.S. Pat. No. 4,150,445 disclose a shower chair assembly. Hancock, U.S. Pat. No. 4,091,479 discloses a shower chair. Davies, U.S. Pat. No. 4,168,549 discloses a seat for use with a bathing device and Myers, U.S. Pat. No. 5,373,591 discloses a shower Comdt chair and transfer track.

Although there are a number of devices to assist amputees and invalids into baths in addition to those listed above, often amputees and invalids are unable to move themselves into and out of the bath with ease and require a great amount of assistance and lifting. Although the prior devices have proved to have a number of advantages, there are also a number of disadvantages, for example, they are too heavy, not easily managed and not easily installed and some are very elaborate and expensive in structure. Therefore, there is a need for a collapsible transfer bench which is easily set up but also can easily be collapsed and is portable enough to be able to put into a suitcase and be able to move from one location to the other and used for transfer of non ambulatory persons into and out of bathtubs, Comdt as well as automobiles and beds.

SUMMARY OF THE INVENTION

The present invention a collapsible transfer bench comprises (a) a moveable seat; and (b) a frame collapsible between an extended position and a collapsed position, wherein in said extended position said frame supporting said seat and cooperatively adapted for said seat to be moveable along said frame, and in said collapsed position said collapsible transfer bench portable enough for one person to transport said bench from one location to the other.

Preferably said seat being collapsible between an extended and a collapsed position.

Preferably said frame is collapsible by folding said frame between said extended position and said collapsed position.

Preferably said frame further comprises channels foldable between said extended and said collapsed position.

Preferably said frame further comprises legs foldable between said extended position and said collapsed position.

Preferably said seat is adapted to rollably move along said channels.

Preferably said seat includes a back, sides and a bottom, all collapsible between an extended position and a collapsed position.

In a presently preferred embodiment the present invention a collapsible transfer bench comprises (a) a frame moveable between an extended position and a collapsed position, said frame including at least one channel;

(b) a seat adapted to receive and support a person, said seat cooperatively and moveably engaging said channel such that in said extended position said seat moves longitudinally along said channel and in said collapsed position said frame is portable enough for one person to transport said frame from one location to the other.

Preferably said frame further comprises a leg means for supporting said frame and said seat.

Preferably said leg means comprises legs moveable between an extended position and a collapsed position, such that in said collapsed position said frame is transportable by one person from one location to another.

Preferably said seat being moveable between a seat extended position and a seat collapsed position, such that in said collapsed position said frame together with said seat is portable enough to be transportable by one person from one location to another.

Preferably said seat includes a back, sides and a bottom, all collapsible and moveable between an extended position and a collapsed position.

Preferably said seat is adapted to rollably engage with and move longitudinally along said channel.

Preferably said channel includes a first channel section and a second channel section including a joining means for joining together the sections at distal ends thereof, such that in the extended position the two sections form a continuous longitudinal section and in the collapsed position the two sections fold upon each other for transportation.

Preferably said joining means includes a hinge for pivotally connecting first channel section and second channel section.

BRIEF DESCRIPTION OF THE DRAWINGS

The preferred embodiments of the invention will now be described by way of example only with reference to the following drawings:

FIG. 7 is a side elevational view of the seat in the extended position.

FIG. 8 is a side elevational view of the seat in the collapsed position.

FIG. 9 is a planned perspective view of the seat showing how the various components of the seats move in order to collapse into the collapsed position.

FIG. 10 is a planned perspective view of the seat in the collapsed position.

FIG. 13 is a side longitudinal elevational view showing circle 14 the details of the collapsible channel.

FIG. 14 is a plan perspective view of the details showing FIG. 13 as circle 14 indicating how the channels collapse.

DETAILED DESCRIPTION OF THE PREFERRED EMBODIMENT

Figure 1:
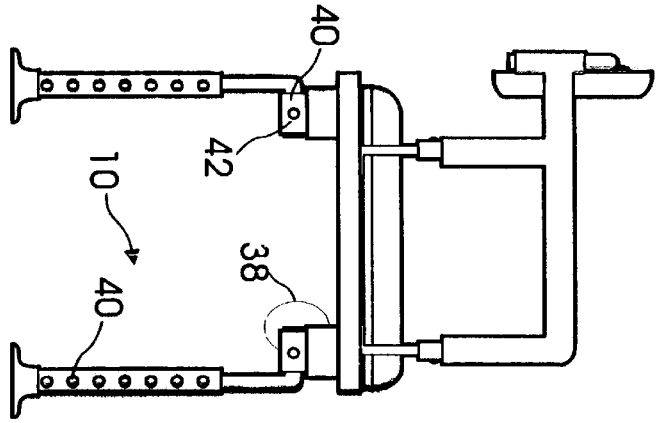
FIG. 1 is a side transverse elevational view of the collapsible transfer bench.

The present invention a collapsible transfer bench shown generally as 10 includes a frame 12, having channels 14, legs 16, end members 18, as well as a seat 20 which includes bottom 22, side 24 and back 26.

Figure 2:
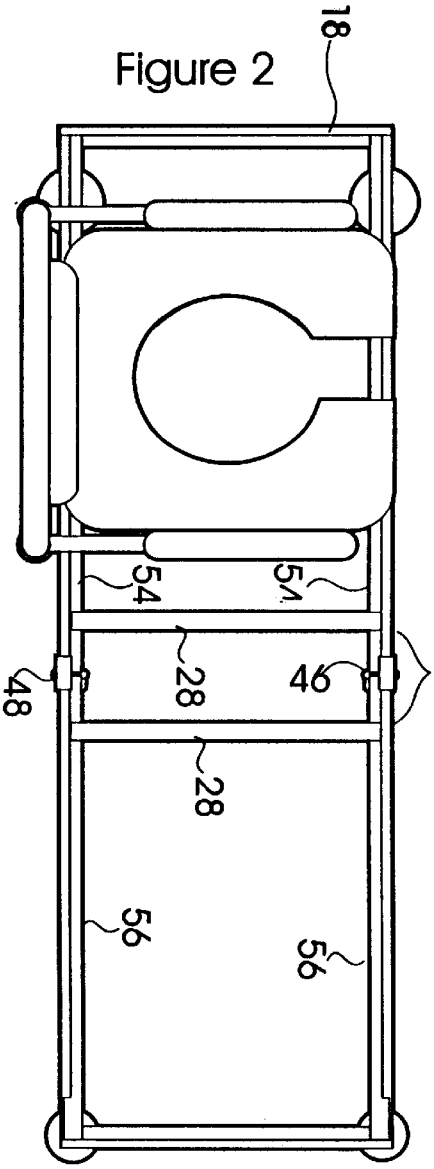
FIG. 2 is a top view of the collapsible transfer bench.
Figure 3:
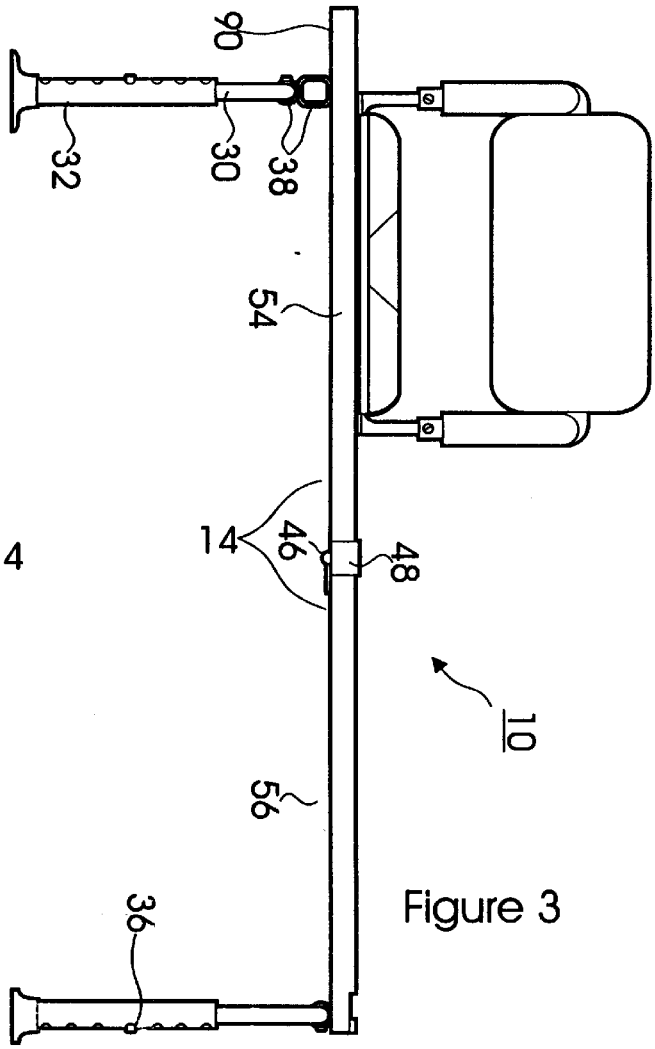
FIG. 3 is a side longitudinal elevational view of the collapsible transfer bench.

Referring now to FIGS. 1, 2 and 3. Legs 16 include upper leg 30 and lower leg 32 which telescopically extends with respect to upper leg 30 and includes apertures 34 which cooperate with a spring biased locking plunger 36 in order to provide for height adjustment of leg 16. Upper leg 30 is pivotally mounted to leg bracket 38 which has aperture 40 cooperating with locking pin 42 for locking leg 16 in the extended position. Depressing locking pin 42, allows leg 16 to pivot between an extended position and a collapsed position shown and described in FIGS. 13 to 19.

Frame 12 includes end members 18, cross members 28, first channel section 54, second channel section 56, locking element 48 and hinge 46. Preferably channels 14 are "C" shaped channels made out of extruded aluminum and/or steel and second channel 56 and first channel section 54 are pivotally connected together with hinge 46, approximately mid way along the entire length of channels 14. Locking element 48 can be slidably moved across the joint between first channel 54 and second channel 56 for locking and preventing pivoting of first and second channels 54 and 56 with respect to each other. Channels 14 are connected at their longitudinal ends with end members 18 and preferably are welded together and/or joined together by any fastening or joining means known in the art. In addition to end members 18 holding together channels 14, cross members 28 positioned on either side of the joint between second channel section 56 and first channel section 54, help maintain dimensional stability and rigidity of channels 14 when they are in a collapsed position.

Figure 4:
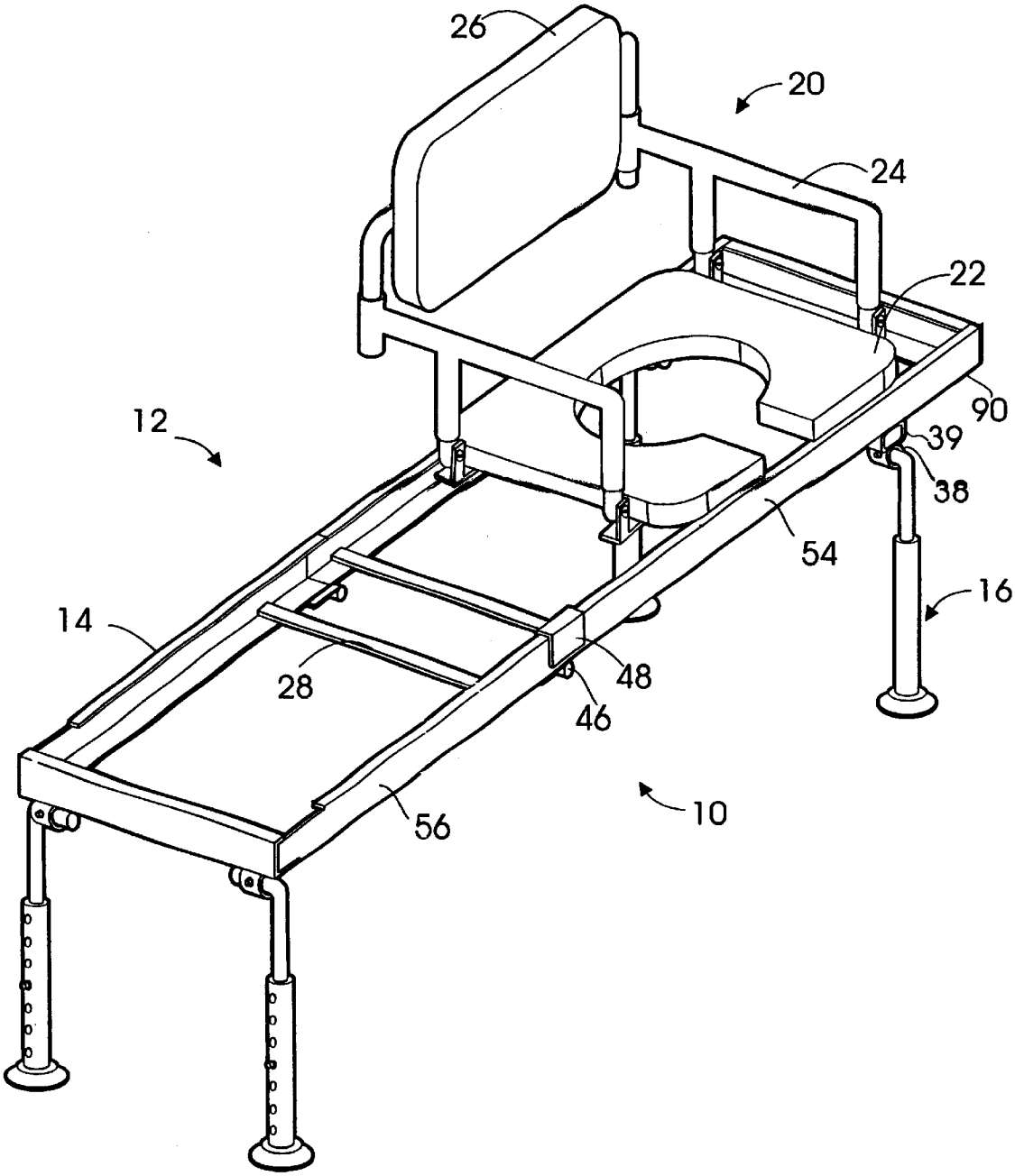
FIG. 4 is a plan perspective view of the collapsible transfer bench.
Figure 16:
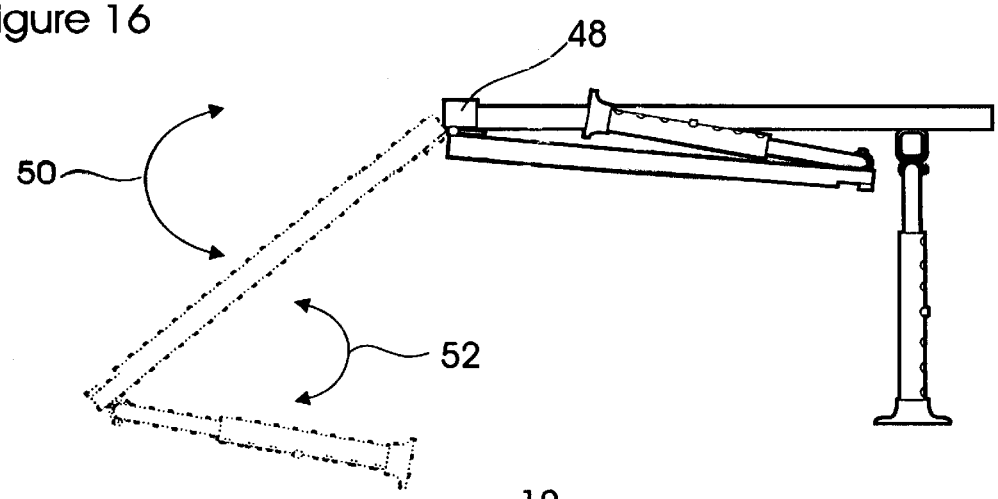
FIG. 16 shows schematically how the channels and legs collapse inwardly.
Figure 17:
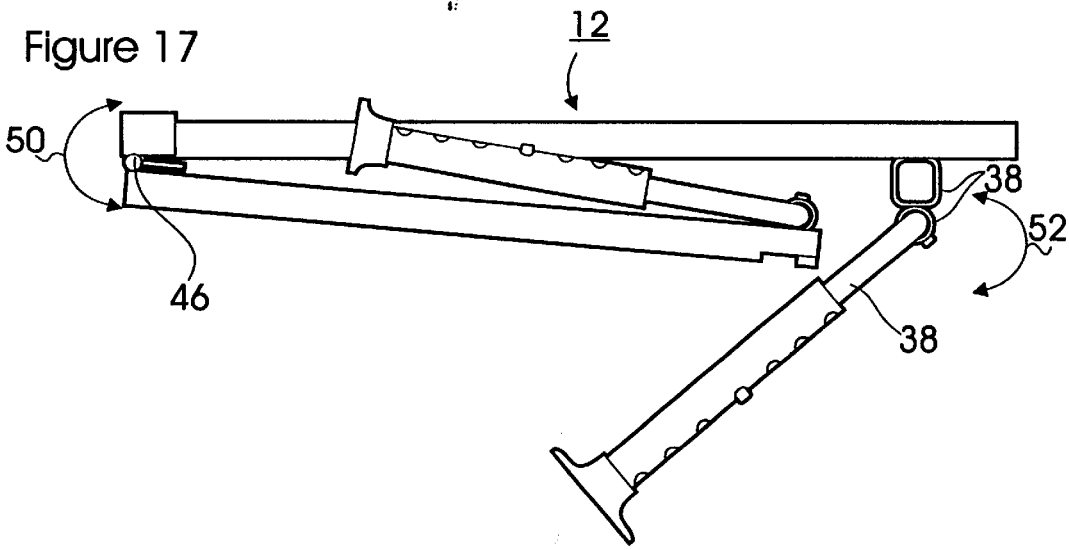
FIG. 17 again shows schematically how the channels and legs collapse inwardly.
Figure 18:
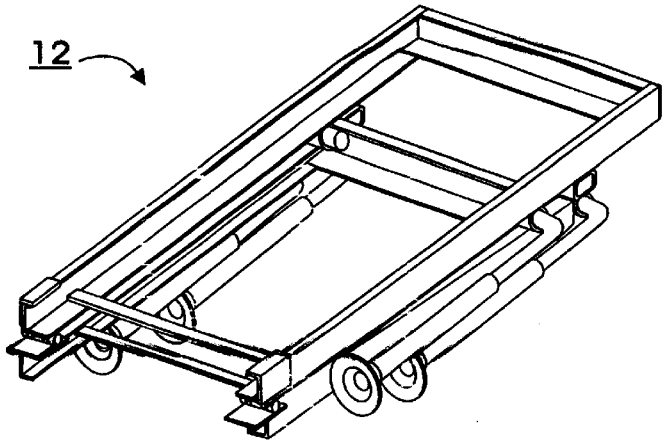
FIG. 18 is a planned perspective view of the collapsible transfer bench shown in the collapsed position without the seat.

Referring now to FIGS. 13 through 18, frame 12 with legs attached is shown in the extended position in FIGS. 4 and 13 and in a collapsed position in FIG. 18. First channel section 54 and second channel section 56 pivot about hinge 46 through channel pivoting motion shown as 50 in FIG. 16. In addition, legs 16 also pivot about leg brackets 38 and 37 thereby collapsing frame 12 to approximately half its length from the extended position to the collapsed position. FIG. 16 and 17 show schematically how frame 12 would be collapsed and the sequence of collapsing frame 12 from the extended position shown in FIG. 15 to the collapsed position shown in 18. FIG. 18 shows frame 12 in the collapsed position as you can see the frame in the collapsed position is approximately half the longitudinal length it is in the extended position.

Figure 19:
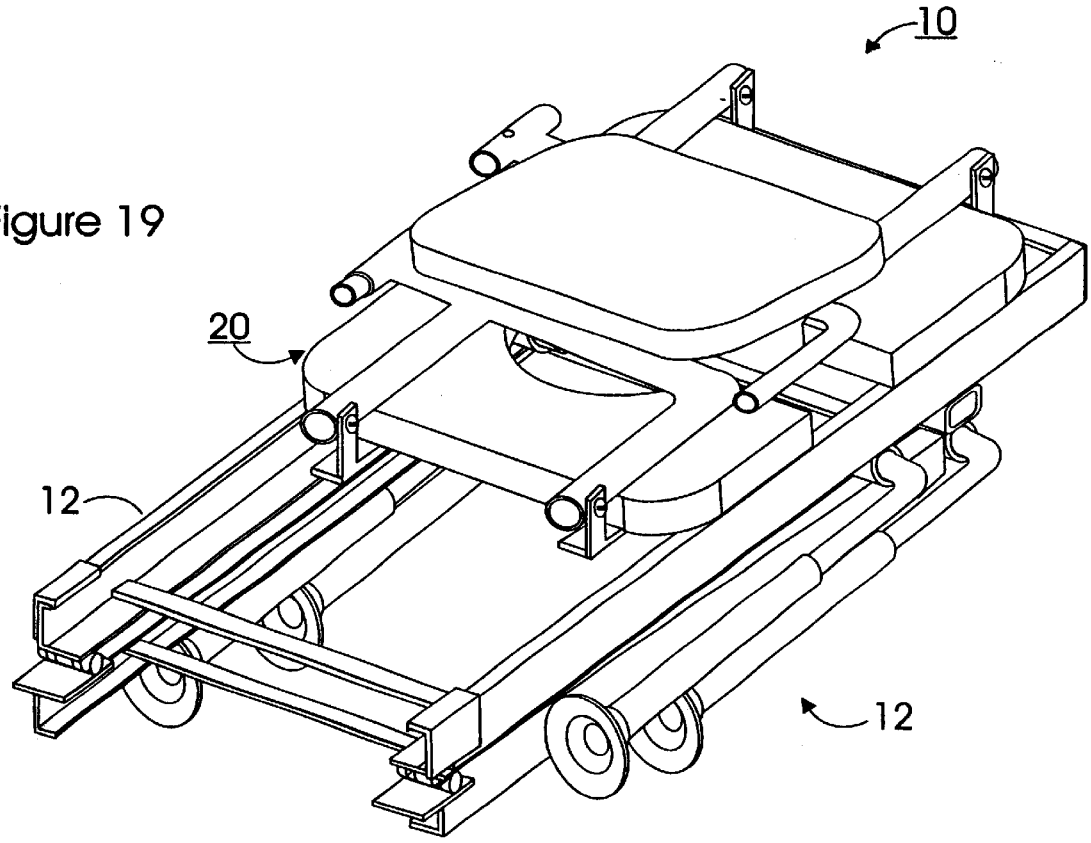
FIG. 19 is a planned perspective view of the collapsible transfer bench shown collapsed with all components including the seat in situ.

Referring now to FIGS. 7, 8, 9 and 10 which shows seat 20 and the sequence to collapse seat 20 from the extended position shown in FIG. 7 to a collapsed position shown in FIGS. 8 and 10. FIG. 9 shows how seat 20 can be collapsed. Back 26 is slidably attached to sides 24 and can be moved up and down through back sliding motion shown as 74 on FIG. 9. As well sides 24 are pivotally attached to bottom 22 of seat 20 and can be pivoted through side pivoting motion shown as 72 on FIG. 9. Seat 20 is shown in the totally collapsed position in FIG. 10 wherein the sides 24 and back 26 of seat 20 are collapsed onto bottom 22 of seat 20. FIG. 19 shows collapsed frame 12 as well as collapsed seat 20 nested together into one package suitable for placing inside a suitcase or box for transportation.

Figure 5:
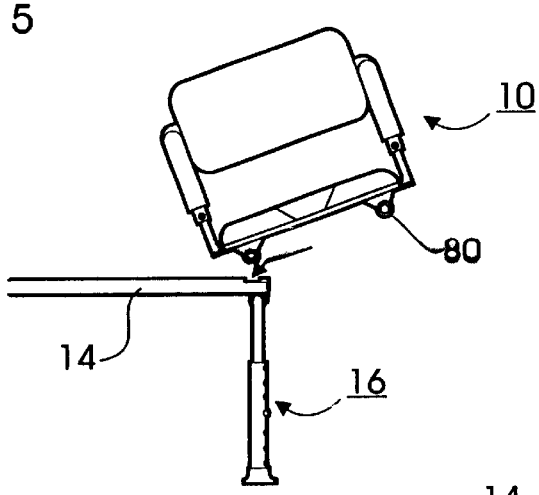
FIG. 5 illustrates schematically how the seat is fit into the channels for positioning onto the collapsible transfer bench.

Referring now FIGS. 5, 6, 11 and 12 which shows seat 20 of collapsible transfer bench 10 being inserted into channel entries 82 for rollably moving along channels 14 of frame 12. Seat 20 has attached on the bottom 22, wheels 80 for rollably moving along the bottom of channels 14. Seat 20 as shown in FIG. 5 is tilted slightly in order that wheels 80 are inserted through channel entries 82 and onto channels 14.

Figure 11:
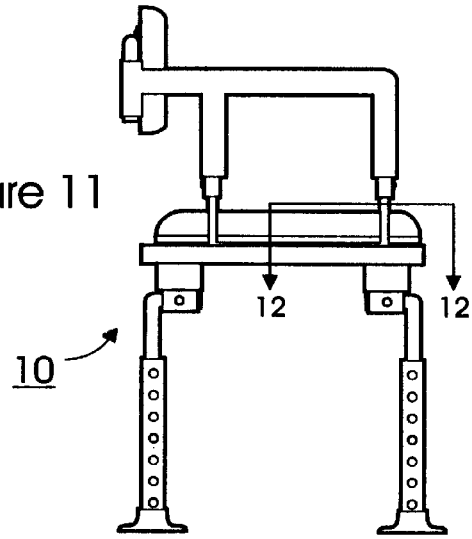
FIG. 11 is a side transverse elevational view showing the cross-sectional taken through lines 12—12 shown in FIG. 12.
Figure 12:
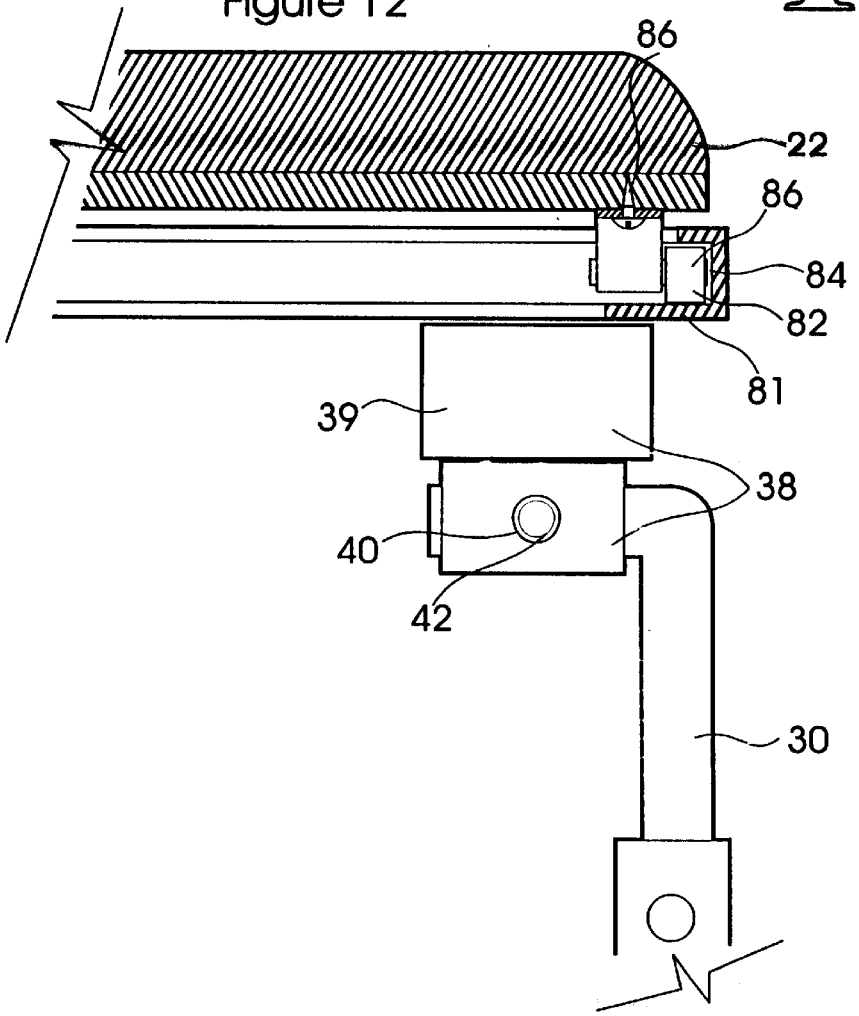
FIG. 12 is a cross-sectional view taken along lines 12—12 of FIG. 11 showing some cross-sectional details of the channel, the wheel and the seat.
Figure 15:
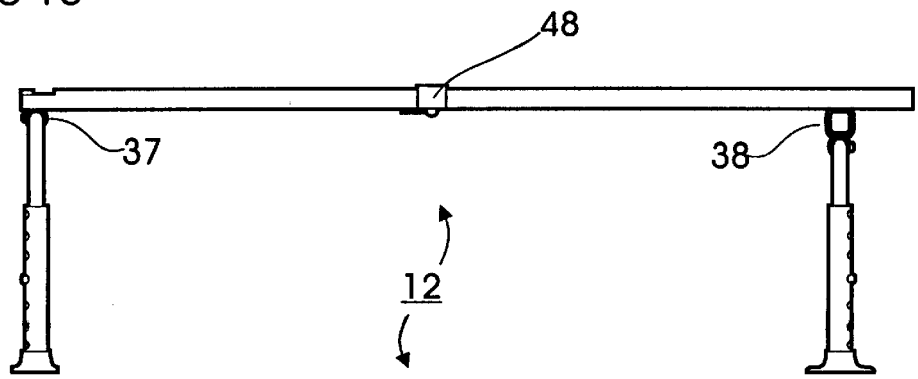
FIG. 15 is a side longitudinal elevational view of the collapsible transfer bench.

Referring now to FIGS. 11 and 12 particularly, wheel 82 is rotatably mounted on axle 84 which is rigidly mounted to axle housing 86 which is fastened using screws 88 to bottom 22. In addition, FIG. 12 shows the detail of leg brackets 38, locking pin 42 and upper leg 30 which pivotally moves within leg bracket 38. Locking pin 42 is resiliently biased within upper leg 30 and in the extended position locking pin 42 is housed within aperture 40 therefore preventing upper leg 30 from collapsing or pivoting. Bottom 22 of seat 20 can be made of any suitable material having enough strength and rigidity to support the weight of a person and/or disabled person upon collapsible transfer bench 10.

The reader will note that leg bracket 38 on one end includes spacer 39 whereas on the other end leg bracket 37 only includes the housing member for upper leg 30 without spacer 39. This ensures that legs 16 are able to nest together properly in order to minimize the space requirements for the collapsed legs 16 of collapsed fame 12.

Additionally, at one end the legs are spaced slightly away from the longitudinal end of channels 14. This is in order to provide a supporting surface 90 which can be used to mount the end of frame 12 onto for example the ledge of a car or onto a bed or onto the edge of a bathtub and/or whirl pool tub. Supporting surface 90 can be used in addition to legs 16 or over and above legs 16 depending upon the height requirements for the positioning of frame 12.

Figure 6:
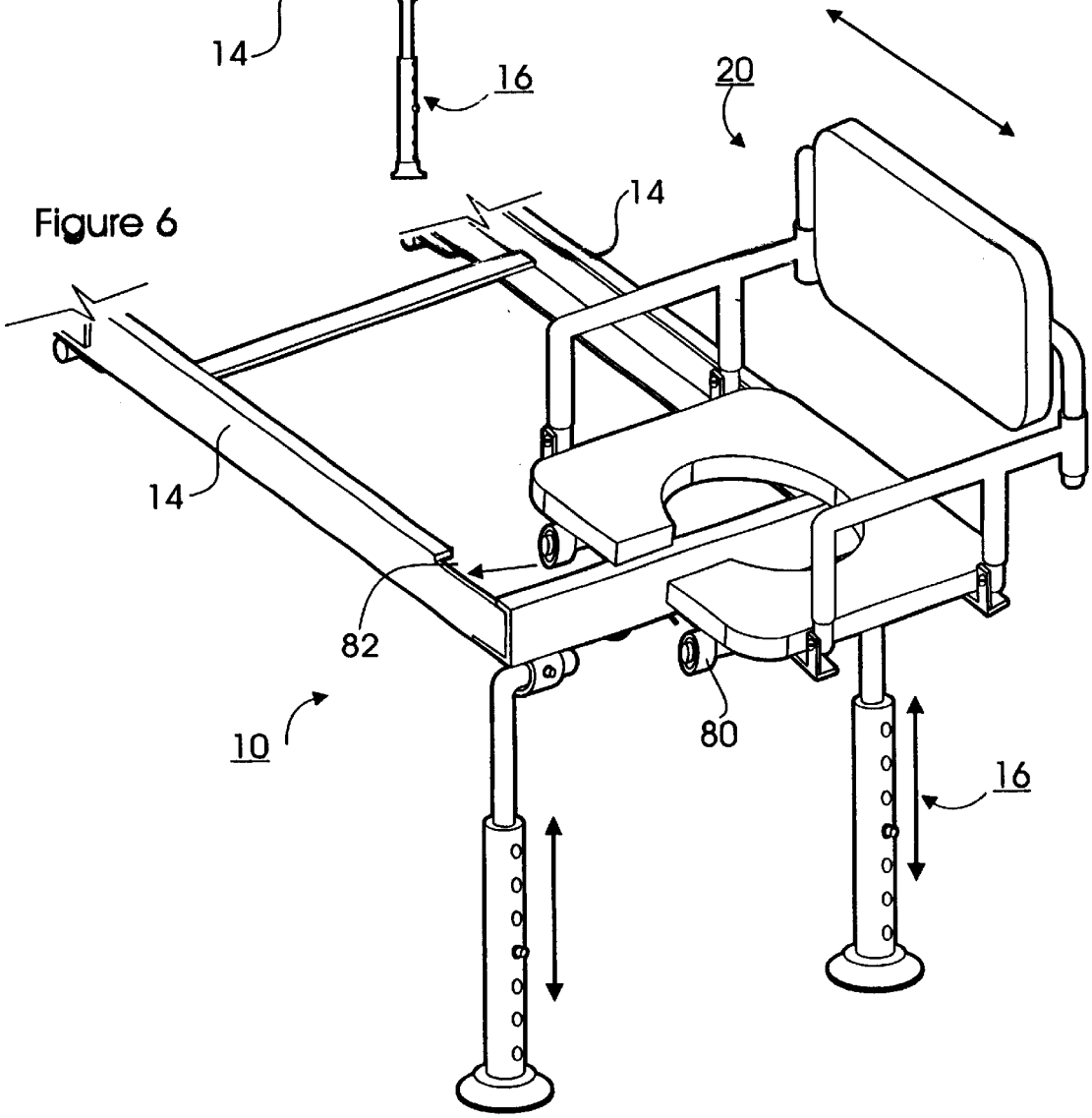
FIG. 6 is a partial cut away plan perspective view showing how the seat fits into the channels and the height adjustability of the legs.

In use frame 12 is set up in the extended position as shown in FIGS. 1 through 4. In the extended position seat 20 rolls along the longitudinal length of channels 14 thereby allowing a person sitting on seat 20 to move from one end of the frame 12 to the other. The heights of leg 16 are adjusted by selecting an aperture 34 which cooperates with a locking plunger 36 which is resiliently biased and attached to upper leg 30. By depressing locking plunger 36 one can telescopically move lover leg 32 up and down along upper leg 30 until the desired height is reached and locking plunger 36 is then selectively locked into one of the apertures 34 of lower leg 32. You will see that the height adjustment capability of each leg 16 is independent of the other and therefore, frame 12 can be set up on a uneven surface by adjusting the height of the legs to ensure that the frame is in the horizontal position or on an angle if so desired. If for example, one end of frame 12 must be placed in an area were legs 16 cannot be utilized, then supporting surface 90 can be placed on for example the ledge of the door frame of a car or onto a seat, or onto one end of a mattress in order to move the disabled person from one end of the frame to the other. Normally seat 20 is used in the extended position as shown in FIG. 4 as well as shown in FIGS. 5, 6 and 7. The seat can be placed into channels 14 facing in either direction by inserting wheels 80 of seat 20 into channel entries 82 in the top of channels 14. By tilting the seat slightly as shown in FIG. 5, this help facilitate entry of wheels 80 into channel entires 82. The wheels are supported by bottom flange 81 of channels 14.

One of the benefits of the present collapsible transfer bench 10 is that it can be collapsed to a very small size for portability for use both in home and/or while travelling or for use into and out of cars and/or in hotels or motels. In collapsed position a single person can transport collapsible transfer bench 10.

In order to collapse frame 12 first of all, locking element 48 is slid along channel 14 thereby exposing the joints where first channel section 54 and second channel 56 butt together. First and seconds channels 54 and 56 respectively are joined by hinge 46. Referring now to FIGS. 16 and 17, leg 16 is pivoted through leg pivoting motion 52 as shown in FIG. 16 and then second channel section 56 is pivoted through channel pivoting motion 50 as shown in FIG. 16 thereby collapsing leg 16 and second channel section 56 as shown in FIG. 16. Subsequently, the remaining extended legs 16 are pivoted about leg pivoting motion 52 as shown as FIG. 17 completing the collapsing of frame 12. Frame 12 is shown in the totally collapsed position in FIG. 18. Frame 12 and legs 16 are nicely nested tother to form a very compact structure for transportation from one location to the other. Brackets 38 which pivotally attach to upper leg 30 additionally have a spacer 39 on first channel section 54, this in order to ensure that legs 16 nest properly together as shown in FIG. 18.

Referring now to FIGS. 7, 8, 9 and 10 which shows schematically how seat 20 can be moved from the extended position shown in FIG. 7 shown in the collapsed position shown in FIG. 8. First of all back 26 is raised in a sliding motion shown as back sliding motion 74, upwardly from sides 24 of seat 20. This sliding motion releases one side of back tubing 100 from seat tubing 102. Back tubing 100 fits telescopically and slidably within seat tubing 102 and as well it enables pivoting of back 26 about pivot axis 104 and through back pivot motion shown as 70. Subsequently, sides 24 pivoting about hinges 110 are pivoted through side pivoting motion 72 as shown in FIG. 9 so that sides 24 are collapsed such that they rest on bottom 22 of seat 20. The final result is shown in FIG. 10 wherein seat 20 is shown in the totally collapsed position. In FIG. 19, frame 12 as well as seat 20 are shown together both in the collapsed position, wherein the wheels 82 of seat 20 are housed within channels 14 of frame 12 so that both the seat and the frame 12 do not separate from each other. The entire unit is nested very nicely so that it is easily portable from one location to the other.

It should be apparent to persons skilled in the arts that various modifications and adaptation of this structure described above are possible without departure from the spirit of the invention the scope of which defined in the appended Claims.

I claim:

1. A collapsible transfer bench comprising:

(a) a moveable seat; and (b) a frame collapsible between an extended position and a collapsed position, wherein in said extended position said frame supporting said seat and cooperatively adapted for said seat to be moveable along said frame, and in said collapsed position said collapsible transfer bench portable enough for one person to transport said bench from one location to the other;

(c) wherein said frame is collapsible by folding said frame between said extended position and said collapsed position;

(d) wherein said frame further comprises channels foldable between said extended and said collapsed position; and, (e) wherein said frame further comprises legs foldable between said extended position and said collapsed position.

2. The collapsible transfer bench claimed in claim 1 wherein said seat being collapsible between an extended and a collapsed position.

3. The collapsible transfer bench claimed in claim 2 wherein said seat includes a back, sides and a bottom, all collapsible between an extended position and a collapsed position.

4. The collapsible transfer bench claimed in claim 1, wherein said seat is adapted to rollably move along said channels.

5. A collapsible transfer bench comprising:

(a) a frame moveable between an extended position and a collapsed position, said frame including at least two channels;

(b) a seat adapted to receive and support a person, said seat moveably engaging along said channels such that in said extended position said seat moves longitudinally along said channel and in said collapsed position said frame is portable enough for one person to transport said frame from one location to the other; and, (c) wherein said channel includes a first channel section and a second channel section including a joining means for joining together the sections at distal ends thereof, such that in the extended position the two sections form a continuous longitudinal section and in the collapsed position the two sections nest together by folding upon each other for transportation.

6. The collapsible transfer bench claimed in claim 5, wherein said frame further comprises a leg means for supporting said frame and said seat.

7. The collapsible transfer bench claimed in claim 6, wherein said leg means comprises legs moveable between an extended position and a collapsed position, such that in said collapsed position said frame is transportable by one person from one location to another.

8. The collapsible transfer bench claimed in claim 7, wherein said seat being moveable between an extended position and a collapsed position, such that in said collapsed position said frame together with said seat is portable enough to be transportable by one person from one location to another.

9. The collapsible transfer bench claimed in claim 8 wherein said seat includes a back, sides and a bottom, all collapsible and moveable between an extended position and a collapsed position.

10. The collapsible transfer bench claimed in claim 9 wherein the seat in the collapsed positon the sides, back, and seat are nested together such that the sides and back are substantially folded upon the seat.

11. The collapsible transfer bench claimed in claim 7 where in said legs in said collapsed position nest to fold upon said frame to lie substantially parallel along said frame.

12. The collapsible transfer bench claimed in claim 5 wherein said seat is adapted to rollably engage with and move longitudinally along said channel.

13. The collapsible transfer bench claimed in claim 5 wherein said joining means includes a hinge for pivotally connecting first channel section and second channel section.

14. The collapsible transfer bench claimed in claim 5; wherein a) said frame further comprises a leg means for supporting said frame and said seat;

b) wherein said leg means comprises legs moveable between an extended position and a collapsed position;

c) wherein said legs in said collapsed position nest to fold upon said frame to lie substantially parallel along said frame;

d) wherein said seat being moveable between an extended position and a collapsed position;

e) wherein said seat includes a back, sides and a bottom, all collapsible and moveable between an extended position and a collapsed position;

f) wherein said seat is adapted to rollably engage with and move longitudinally along said channel;

g) wherein the seat in the collapsed position the sides, back, and seat are nested together such that the sides and back are substantially folded upon the seat;

h) wherein said channel includes a first channel section and a second channel section including a joining means for joining together the sections at distal ends thereof, such that in the extended position the two sections form a continuous longitudinal section and in the collapsed position the two sections nest together by folding upon each other for transportation; and i) wherein said joining means includes a hinge for pivotally connecting first channel section and second channel section. j) such that when said seat, frame and legs are in said collapsed position said transfer bench is transportable by one person from one location to another.

* * * * *